US005883600A

United States Patent [19]

Kukura

[11] Patent Number: 5,883,600

[45] Date of Patent: Mar. 16, 1999

[54] TUNEABLE ANTENNA

[76] Inventor: Frank J. Kukura, 1426 E. Indianola Ave., Youngstown, Ohio 44502

[21] Appl. No.: 746,473

[22] Filed: Nov. 12, 1996

[51] Int. Cl.[6] ..... H01Q 9/32

[52] U.S. Cl. ..... 343/745; 343/750; 343/846; 343/861

[58] Field of Search ..... 343/745, 749, 343/750, 751, 860, 861, 846; H01Q 9/00, 9/04, 9/32

[56] References Cited

U.S. PATENT DOCUMENTS 3,541,554 11/1970 Shirey ..... 343/750
3,798,654 3/1974 Martino et al. ..... 343/750
4,080,604 3/1978 Wosniewski ..... 343/750
4,117,493 9/1978 Altmayer ..... 343/750

*Primary Examiner*—Michael C. Wimer
*Attorney, Agent, or Firm*—Harpman & Harpman

[57] ABSTRACT

A tuneable antenna including an elongated radiating element with a conductive loading coil positioned on an insulating member. A capacitor is formed above the loading coil with a conductive member overlying the loading coil and movable with respect to the coil and the capacitor to change the resonant frequency of the antenna.

9 Claims, 2 Drawing Sheets

TUNEABLE ANTENNA

BACKGROUND OF THE INVENTION

1. Technical Field

This invention relates to tuneable radio antennas having loading coils for impedance matching to a co-axial feed line.

2. Description of Prior Art

Prior art antenna radiating elements are typically matched to feed lines by using a tapped loading coil at the feed point of the co-axial feed line. Prior art devices have used a number of different approaches to tune such antennas given the nature of the selective structures. One variation is to couple the ground end of the loading coil through a variable capacitor to the ground plane, such as a mechanical body. Tuning is then achieved by rotating a variable capacitor depicting a series resonant tuning circuit.

An alternate method is described as parallel resonant tuning circuit in which a variable capacitor is connected between the antenna radiating element (beyond the loading coil) and ground. The variable capacitor is rotated to tune the antenna. These prior art attempts to use capacitance means for tuning are typically complex and require adjusting capacitances by hand during operation.

Prior art examples of the tuning methods described above can be seen, for example, in U.S. Pat. Nos. 3,541,554, 3,798,354, and 4,080,604.

In U.S. Pat. No. 3,541,554 a tuneable whip antenna is disclosed using a pair of inductant coil in series between the load in cable and radiating element. A ring is peripherally disposed thereabout for adjustably varying the mutual inductance between the coils.

U.S. Pat. No. 3,798,654 is directed to a tuneable sleeve on a radiating element with a resonant tuning coil coupled thereto and electrically coupled tuning element.

A means for tuning a loaded coil antenna is disclosed in U.S. Pat. No. 4,080,604 wherein a loading coil has a conductive member opposite several turns of the loading coil and is disposed in distributive capacitive relationship therewith. The conductive member is movable along the coil surface to change the effective resonant frequency of the antenna.

SUMMARY OF THE INVENTION

A tuneable antenna is provided with a feed loading coil and a movable conductive member extending over and selectively beyond the loading coil to effect a change in capacitance by overlying a portion of a fixed capacitor positioned above the loading coil, thus adjusting the impedance of the loading coil so that the antenna is resonant at a given frequency. The conductive member is grounded to the infeed before the loading coil. The capacitor achieves an inductive feed to a radiating element extending therefrom.

DESCRIPTION OF THE PREFERRED EMBODIMENT

Figure 1:
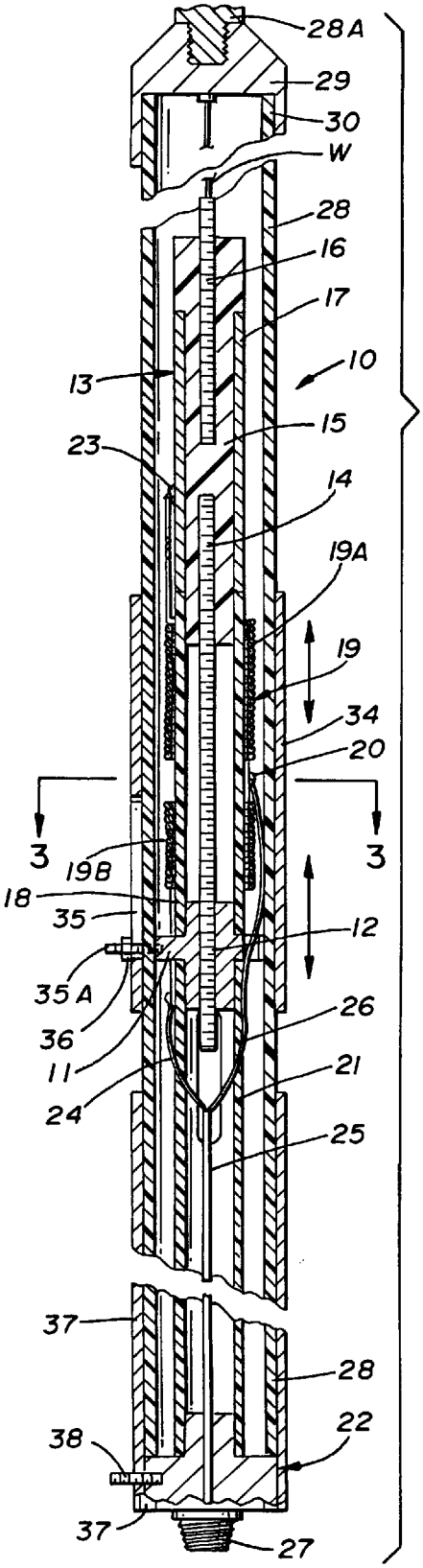
FIG. 1 is a partial elevational cross-sectional view of the embodiment of the invention.
Figure 2:
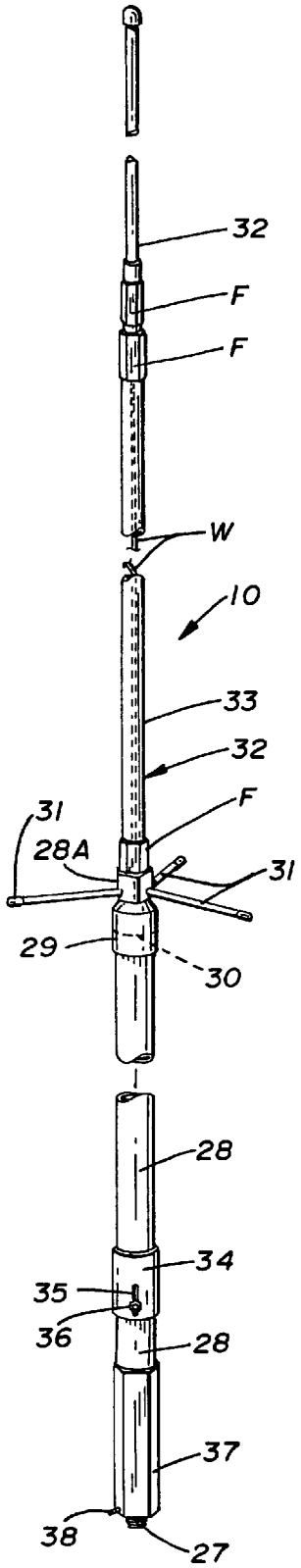
FIG. 2 is a perspective view of the invention with portions broken away.
Figure 3:
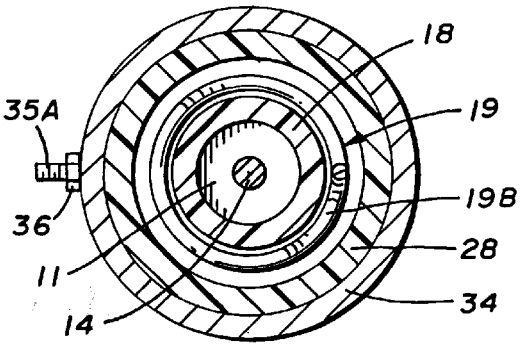
FIG. 3 is a sectional view on lines 3—3 of FIG. 1.

Referring now to FIGS. 1–3 of the drawings, a tuneable antenna 10 can be seen having a coil support fitting 11 with a continuous threaded bore at 12 therethrough. A capacitor 13 is formed from a parallel/series first threaded conductive rod 14 extending from the coil support fitting 11 registerable within an insulation rod 15. A second threaded rod 16 extends from the insulated rod in longitudinally spaced axially aligned relation to said first conductive rod 14. A fixed conductive sleeve 17 extends about a portion of said insulation rod 15 overlying said respective first and second conductive rods 14 and 16 thereon.

An insulation tube 18 extends from said coil support fitting over and in spaced relation to said first conductive rod to said conductive sleeve 17, best seen in FIG. 1 of the drawings. A loading coil 19 is wound about said insulating tube 18 between the coiled support fitting 11 and in spaced relation to the conductive sleeve 17. The loading coil 19 is a two-step coil with an upper portion 19A and a spaced lower portion 19B and is centrally tapped therebetween at 20 as will be described in greater detail hereinafter.

A non-conductive tubular antenna support element 21 extends from the coil support fitting 11 opposite said insulation tube 18 to an antenna mounting base 22.

The upper portion 19A of the loading coil 19 is electrically connected to the capacitor's conductive sleeve 17 at 23 by soldering and the coils lower portion 19B is affixed through said coil fitting 11 to a ground sheath 24 of a co-axial feed line 25. A center conductor 26 of the co-axial feed line 25 is electrically connected to the loading coil's central tap at 20 between the coil portions 19A and B as hereinbefore described.

The co-axial feed line 25 extends from the load coil 19 and coil support fitting 11 within the tubular support element 21 to a cable adapter 27 commonly known as SO-239 within the art within the mounting base 22 to provide a threaded electrical mounting connection fitting for antennas.

A non-conductive enclosure 28 extends from the mounting base 22 over the hereinbefore described antenna assembly to a conductive antenna ferrule fitting 29 which is affixed to the tube 28 free end at 30. An extension fitting 28A is threadably engaged into the antenna ferrule 29 by a threaded base fitting 29A and has a plurality of conductive radials (rods) 31 threadably extending outwardly therefrom as is typical in an antenna construction. The antenna ferrule 29 in turn threadably receives one of multiple conductive antenna extension members 32 having a non-conductive housing 33 between conductive fittings F. The connector fittings F of the antenna extension members 32 have respective male and female ends for securing to one another with an antenna wire W extending therethrough electrically interconnecting the respective fittings F again as is well understood in antenna construction.

Figure 4:
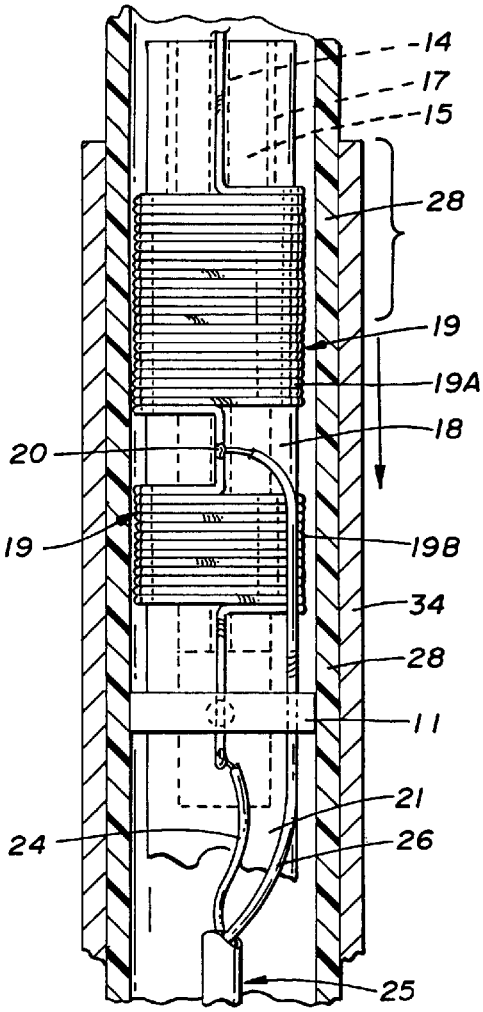
FIG. 4 is an enlarged elevational view similar to FIG. 1.
Figure 5:
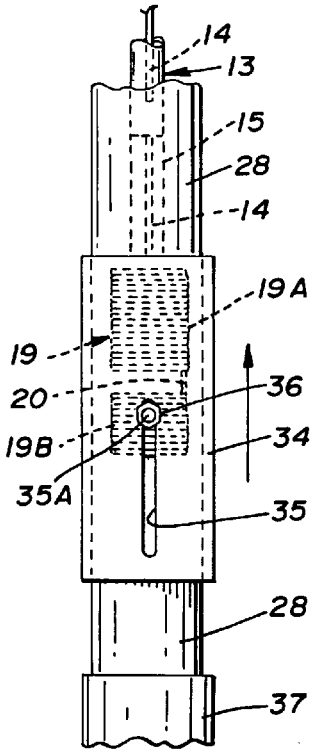
FIG. 5 is side elevational view similar to FIG. 4 showing the movable sleeve in base position.

Referring now to FIGS. 1, 2, 4, and 5 of the drawings, a tuning sleeve 34 of the invention is positioned on the support tube 28 having an adjustment slot extending longitudinally therein at 35. A guide and ground pin 35A extends from said coil support fitting 11 through the adjustment slot 35 with a fixation nut 36 threadably engaged thereon grounding the tuning sleeve 34 to the antenna. It is important to note that the tuning sleeve 34 covers the entire loading coil 19 within the support tube 28 at all times regardless of the relative vertical adjustment (movement) of the sleeve on the tube 28 as best seen in FIGS. 2, 4, and 5 of the drawings.

In use, the antenna of the invention can be tuned to the proper resonant frequency by loosening the fixation nut 36 and axially shifting the tuning sleeve 34 along the tube 28 within the travel parameters of the slot 35 as illustrated by the respective positions indicated in FIGS. 4 and 5 of the drawings. With the tuning sleeve 34 extending below and above the loading coil 19 adjusting impedance is achieved by moving the sleeve 34 between the top of the loading coil portion 19A and the capacitor 13 positioned above the coil. The sliding of the tuning sleeve 34 in spaced relation over the first threaded conductive rod 14 of the capacitor 13 that extends between the capacitor 13 and coil support fitting 11 and through the middle of the coil 19 a varying in capacitance is achieved across the coil 19.

Figure 6:
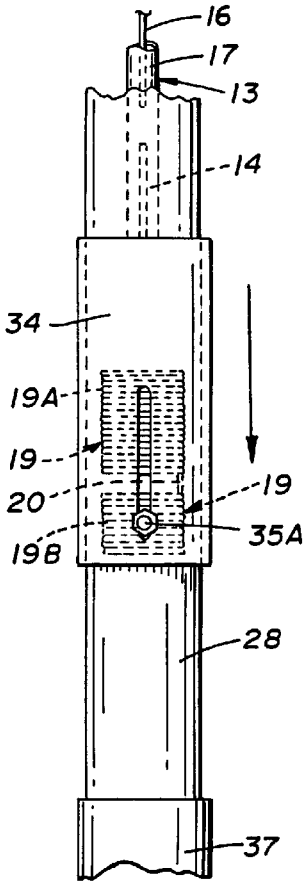
FIG. 6 is a side elevational view as shown in FIG. 5 of the tuneable antenna of the invention with the movable sleeve in maximum vertical position.

Referring now to FIG. 6 of the drawings, the assembled tuning antenna of the invention can be seen wherein a metal enclosure sleeve 37 is fitted about the lower portion of the support tube 28 registerable on the mounting base 22 and secured thereto by a locking pin 38. The enclosure sleeve 37 extends to a point just below the tuning sleeve 34 determining a relative support base for the antenna.

It will appreciated by those skilled in the art that the applicant has illustrated and described a relatively simple tuneable antenna using an adjustable conductive tuning sleeve 34 that overlies the entire loading coil 19 and selective portions of a capacitor 13 above the coil and that the varying capacitance of the coil is achieved by the adjustability of the conductive sleeve 34 thereover.

It will be obvious to those skilled in the art that various changes and modifications may be made therein without departing from the spirit of the invention, therefore I claim:

1. A tuneable antenna loading apparatus comprising; a loading coil having a longitudinal axis, said loading coil having a parallel/series capacitor conductive means and a ground conducting means, a feed conductive means on said loading coil between said respective parallel/series capacitor means and ground conducting means, said loading coil comprises a multiple turn conductor, said parallel/series capacitor means in spaced relation to said loading coil and a movable tuning sleeve overlying all of said loading coil in closed spaced relation thereto, said tuning sleeve being electrically connected to said ground conducting means and mounted for longitudinal movement along the outer periphery of said loading coil from a first position over said loading coil to a second position extending beyond said loading coil, to cover part of a fixed conductive sleeve of said parallel/series capacitor conductive means, ground means interconnecting said movable tuning sleeve, said loading coil and said parallel/series capacitor means to said ground conducting means.

2. The tuneable antenna loading apparatus of claim 1 wherein said parallel/series capacitor means comprises: a pair of longitudinally aligned and spaced conductive rods within and extending from an insulating member, a conductive connective sleeve on said insulative member overlying said respective conductive rods in spaced relation thereto, said conductive connective sleeve electrically connected to said load coil and wherein one of said conductive rods is electrically connected to a radiant antenna.

3. The tuneable antenna loading apparatus of claim 2 wherein one of said conductive rods extends through said loading coil to said ground conducting means.

4. The tuneable antenna loading apparatus of claim 2 wherein said second position of said moveable tuning sleeve overlies a portion of said conductive connective sleeve of said parallel/series capacitor creating a parallel capacitor for varying capacitance across said loading coil, varying frequency of the tuned circuit.

5. The tuneable antenna loading apparatus of claim 1 further comprises a longitudinally extending insulation tube, said loading coil wound about the longitudinal axis of said insulation tube.

6. The tuneable antenna loading apparatus of claim 1 wherein said ground conducting means interconnecting said movable tuneable sleeve, said loading coil and said capacitance means comprises a coil supporting fitting in spaced relation to said loading coil and said conductive sleeve.

7. The tuneable antenna loading apparatus of claim 1 wherein said loading coil comprises a coil lower portion.

8. The tuneable antenna loading apparatus of claim 1 wherein said loading coil comprises: a coil upper portion.

9. The tuneable antenna loading apparatus of claim 1 wherein a co-axial feed line has a center feed connector and a ground sheath, said feed line electrically connected to said loading coil at a center tap on said coil and wherein said ground sheath is electrically connected to said ground means.

* * * * *